United States Patent [19]

Ikematsu et al.

[11] Patent Number: 4,525,269

[45] Date of Patent: Jun. 25, 1985

[54] PROCESS FOR THE SOLVENT DEASPHALTING OF ASPHALTENE-CONTAINING HYDROCARBONS

[75] Inventors: Masaki Ikematsu; Isao Honzyo; Kazuo Sakai, all of Yokohama, Japan

[73] Assignee: Nippon Oil Co., Ltd., Tokyo, Japan

[21] Appl. No.: 606,718

[22] Filed: May 3, 1984

Related U.S. Application Data

[63] Continuation-in-part of Ser. No. 454,831, Dec. 30, 1982.

[30] Foreign Application Priority Data

| | | | |
|---|---|---|---|
| Jan. 8, 1982 | [JP] | Japan | 57-999 |
| Apr. 2, 1982 | [JP] | Japan | 57-53695 |
| Apr. 2, 1982 | [JP] | Japan | 57-53696 |
| Apr. 2, 1982 | [JP] | Japan | 57-53933 |
| Apr. 2, 1982 | [JP] | Japan | 57-53934 |

[51] Int. Cl.[3] ..... C10G 21/00; C10G 29/16

[52] U.S. Cl. ..... 208/309; 208/251 R

[58] Field of Search ..... 208/309, 251 R

[56] References Cited

U.S. PATENT DOCUMENTS

| | | | |
|---|---|---|---|
| 2,970,956 | 2/1961 | Shiah | 208/226 |
| 3,798,157 | 3/1974 | Manzanilla et al. | 208/251 R |

*Primary Examiner*—D. E. Gantz
*Assistant Examiner*—O. Chaudhuri
*Attorney, Agent, or Firm*—Bucknam and Archer

[57] ABSTRACT

A process for the solvent deasphalting of asphaltene-containing hydrocarbons which comprising mixing asphaltene-containing hydrocarbons with a metal compound such as aluminum carbonates or titanium (IV) oxide and also with a solvent such as n-heptane, n-hexane, n-heptane or a mixed n-pentane.n-butanol solvent, to form a mixture which is then allowed to stand still to precipitate and separate the asphaltene therefrom thereby obtaining a deasphalted oil.

8 Claims, 1 Drawing Figure

PROCESS FOR THE SOLVENT DEASPHALTING OF ASPHALTENE-CONTAINING HYDROCARBONS

RELATED APPLICATION

This is a continuation-in-part of application Ser. No. 454,831, filed Dec. 30, 1982, now allowed.

This invention relates to a continuous process for the solvent deasphalting of asphaltene-containing hydrocarbons and more particularly it relates to an improved continuous process for the solvent deasphalting of asphaltene-containing hydrocarbons which comprises adding a specific compound and a specific solvent to asphaltene-containing hydrocarbons to separate the asphaltene from said asphaltene-containing hydrocarbons.

Naturally occurring hydrocarbons generally contain a large proportion of aromatic ingredients and also contain a large amount of comparatively high molecular weight asphaltene containing compounds, in concentrated form, including various metal ingredients, sulphur, nitrogen and the like other than carbon and nitrogen. Such asphaltene as contained in the hydrocarbons is harmful in remarkably decreasing the catalytic activity due to the metal ingredients included in the asphaltene in the step of catalytic hydrogenation or catalytic cracking of heavy fraction oils for example. For this reason, when asphaltene-containing hydrocarbons are treated for their effective use, it is often necessitated to remove therefrom the asphaltene which is a harmful ingredient.

A conventional method for the removal of the asphaltene from asphaltene-containing hydrocarbons is generally illustrated by a solvent deasphalting method comprising using low boiling paraffinic hydrocarbons including propane and butane to light naphtha in separating and removing the asphaltene from asphaltene-containing hydrocarbons.

This conventional solvent deasphalting method comprises deasphalting and solvent recovery. Formerly, the deasphalting was effected by a gravity precipitation system comprising mixing starting hydrocarbons with a solvent and then introducing the resulting mixture into multiple-stage settlers to separate the asphaltene. However, this system is low in separation efficiency; thus, at present, the starting hydrocarbons are charged into an extraction tower (such as a baffle tower or rotary disc tower) at the top, while a solvent (such as propane, butane or pentane) is charged into the extraction tower at the portion near the bottom, and the hydrocarbons and solvent in the tower are heated to about 50°–200° C. under such a pressure that the solvent is prevented from evaporation at said temperature thereby to recover the deasphalted hydrocarbons with a part of the solvent from the tower at the top and the asphaltene with the remainder of the solvent therefrom at the bottom. This countercurrent extraction tower system is the most prevalently used and, further, similar systems of this type have been proposed and carried out. Furthermore, there are also known not only a forced separation system comprising mixing a heavy fraction oil with a solvent such as pentane or hexane, maintaining the resulting mixture at a suitable temperature and then separating the asphaltene from the oil, but also an electrostatic precipitation separation system comprising using a solvent mainly containing pentane and applying an electric field to an asphaltene-containing oil in a settler so as to increase the precipitation velocity of the asphaltene, for its separation. The aforementioned various solvent deasphalting systems are particularized in, for example, "Kagaku Kogyo (Chemical Industry), No. 12, pages 31–40, 1976".

However, the countercurrent extraction tower system is disadvantageous in that it requires a large amount of a solvent, it does not exhibit a satisfactorily high yield of a deasphalted oil and it needs a large-scale extraction tower a so as to raise problems as to its economy. Further, it needs a long treating time to separate asphaltene efficiently and also needs strict control of the flow rate, pressure and temperature of a starting oil to be deasphalted, this rendering the industrial operations complicated in many respects.

On the other hand, the forced separation system employing a hydrocyclone is effective in permitting the use of a miniaturized deasphalting apparatus, but, it needs a large-scale centrifuge to attain satisfactory separation efficiency so as to raise problems as to economy and it is not applicable in a case where the asphaltene to be separated is tacky and the degree of refining of deasphalted oil to be obtained is limited. In addition, the electrostatic precipitation separation system needs application of high electric voltage thereby raising problems as to practicability.

As mentioned above, the conventional known methods for solvent deasphalting of asphaltene-containing hydrocarbons have raised various problems as to their economy.

Thus, the present inventors made various studies in attempts to eliminate the aforesaid disadvantages of said conventional methods and, as a result of their studies, they accomplished this invention.

An object of this invention is to provide a continuous process for producing a desired deasphalted oil which is suitable for use as a starting oil in hydrolysis, fluidized catalytic cracking or the like and is obtained by removing harmful asphaltene, which has a high content of metals and causes problems as to decreased catalytic activity, coking and the like in the refining step, from asphaltene-containing hydrocarbons in a short treating time, at a low cost and with satisfactory selectivity by the use of simple operations.

The object of this invention may be achieved by a continuous process which comprises (I) mixing (A) 100 parts by weight of asphaltene-containing hydrocarbons with (B) 0.005–0.8 parts by weight per 100 parts by weight of said asphaltene-containing hydrocarbons of at least one metal compound selected from the group consisting of carbonates and oxides of magnesium, calcium, aluminum and titanium and (C) 50–2,000 parts by weight per 100 parts by weight of said asphaltene-containing hydrocarbons of at least one member selected from the group consisting of the following solvents (1)–(4):

(1) aliphatic and alicyclic hydrocarbons having 3–20 carbon atoms, (2) saturated aliphatic and saturated alicyclic monohydric alcohols having 1–10 carbon atoms, (3) liquid hydrogen sulfide and (4) liquid carbon dioxide to form a mixture of the materials (A), (B) and (C) and then (II) making the thus formed mixture stand still to precipitate and separate the asphaltene therefrom thus obtaining a deasphalted oil.

According to this invention, not only the mixing of the materials (A), (B) and (C) but also the precipitation and separation of asphaltene from said materials are continuously carried out thus continuously obtaining a deasphalted oil.

The continuous process for solvent deasphalting asphaltene-containing hydrocarbons according to this invention will be explained in more detail hereinbelow.

The asphaltene-containing hydrocarbons used herein are various hydrocarbons containing usually 1–50 wt.%, preferably 3–30 wt.%, of asphaltene and they are exemplified by various oils obtained from oil shale, oil sand and tar sand, petroleum type crude oils, oils obtained by cracking the oils by any means, oils obtained by separating and removing a part or greater part of the light fraction from the aforementioned oils by means of distillation or the like, and mixtures thereof. Of these exemplified asphaltene-containing hydrocarbons, the preferred ones are a residual oil obtained by atmospheric pressure distillation of a crude oil, a residual oil obtained by reduced pressure distillation and a residual oil obtained by cracking used in the step of refining of petroleum.

The metal compounds (B) used in this invention are generally in the solid form at ambient temperature (20° C.) and atmospheric pressure (1 atm.). They may be effectively used in this invention whether they are an anhydride or hydrate. Thus, when they are represented by their chemical compound name or chemical formula, these name and formula are each intended to mean not only their anhydride but also their hydrate(s) unless otherwise specified.

The preferable metal compounds (B) are enumerated as indicated below:

(a) magnesium compound selected from the carbonate and oxide of magnesium;
(b) calcium compound selected from the carbonate and oxide of calcium;
(c) aluminum oxide;
(d) titanium oxides and
(e) mixtures of the compounds (a) to (d).

(B)(a) Magnesium carbonate used herein is represented by the chemical formula $MgCO_3$. Magnesium oxide is MgO which is generally called magnesia.

(B)(b) The calcium compounds include calcium carbonate ($CaCO_3$), and calcium oxide (CaO) which is generally called quick lime.

(B)(c) The aluminum compounds include aluminum oxide (alumina, $Al_2O_3$, and alumina gel).

(B)(d) The oxides of titanium oxides and more particularly they are titanium (II) oxide (titanium monoxide; TiO), titanium(III) oxide (dititanium trioxide), titanium sesquioxide; $Ti_2O_3$), titanium(IV) oxide (titanium dioxide, titania; $TiO_2$) and titanium peroxide ($TiO_3$). They also include $\beta$-titanic acid (metatitanic acid; $TiO_2.H_2O \equiv H_2TiO_3$).

The metal compound (B) used in this invention also includes a metal compound containing at least two members selected from the foregoing enumerated magnesium, calcium, aluminum and titanium compounds and further includes a metal compound containing at least one member selected from said enumerated metal compounds and at least one member selected from magnesium, calcium, aluminum and titanium compounds other than said enumerated metal compounds; such metal compounds are illustrated by double salts, basic salts and double oxides. More specifically, these metal compounds include magnesium hydroxycarbonate (basic magnesium carbonate; $3MgCO_3.MgOH_2$), calcium magnesium carbonate ($CaCO_3.MgCO_3$), magnesium aluminum oxide (magnesium aluminate; $MgO.Al_2O_3$), calcium aluminate ($CaO.Al_2O_3$, $3CaO.Al_2O_3$, $CaO.2Al_2O_3$, etc.), magnesium metatitanate ($MgO.TiO_2$) and calcium metatitanate ($CaO.TiO_2$).

The metal compounds (B) according to this invention further include metal compounds containing both at least one member selected from all the metal compounds so far mentioned, and at least one member selected from the sulfate, carbonate and halides of ammonium, the sulfates, carbonates, halides and oxides of alkali metals (Li, Na, K, Rb, Cs) and the oxides of divalent metals (Be, Mn(II), Co(II), Ni(II), Zn, Sr, Cd(II), Ba and Pb(II); the metal compounds so further included are double salts, double oxides, double hydroxides and the like.

The metal compounds so further included are exemplified by ammonium magnesium carbonate ($(NH_4)_2CO_3.MgCO_3$), lithium metaaluminate ($Li_2O.Al_2O_3$), sodium aluminate ($3Na_2O.Al_2O_3$, $Na_2O.Al_2O_3$), potassium metaaluminate ($K_2O.Al_2O_3$), aluminum beryllate (beryllium aluminum oxide; $Al_2O_3.3BeO$), cobalt(II) aluminum oxide (cobalt(II) aluminate; $CoO.Al_2O_3$, $4CoO.3Al_2O_3$), zinc aluminum oxide ($ZnO.Al_2O_3$), strontium aluminate ($3SrO.Al_2O_3$), barium aluminate ($3BaO.Al_2O_3$), sodium orthotitanate ($2Na_2O.TiO_2$), sodium metatitnate ($Na_2O.TiO_2$), potassium metatitanate ($K_2O.TiO_2$), dipotassium dititanate ($K_2O.2TiO_2$), manganese(II) titanium oxide ($MnO.TiO_2$), cobalt(II) titanium oxide (cobaltous titanium oxide, cobaltous titanate; $CoO.TiO_2$), nickel(II) titanium oxide ($NiO.TiO_2$) strontium metatitanate ($SrO.TiO_2$), cadmium(II) titanium oxide ($CdO.TiO_2$), barium orthotitanate ($2BaO.TiO_2$), barium metatitanate ($BaO.TiO_2$) and lead(II) titanium oxide ($PbO.TiO_2$).

The metal compounds (B) still further include naturally occurring and synthetic ones as well as mixtures thereof. The naturally occurring metal compounds used herein include magnesite ($MgCO_3$), periclase (MgO), hydromagnesite ($3MgCO_3.Mg(OH)_2.3H_2O$), calcite ($CaCO_3$), aragonite ($CaCO_3$), limestone ($CaCO_3$), dolomite ($CaCO_3.MgCO_3$), diaspore ($Al_2O_3.H_2O$), boehmite ($Al_2O_3.H_2O$), gibbsite ($Al_2O_3.3H_2O$), hydrargillite ($Al_2O_3.3H_2O$), chrysoberyl ($BeO.Al_2O_3$), gahnite (zinc spinel, $ZnO.Al_2O_3$), spinel ($MgO.Al_2O_3$), galaxite ($MnO.Al_2O_3$), brookite ($TiO_2$), octahedrite ($TiO_2$), rutile ($TiO_2$) and perovskite ($CaO.TiO_2$).

The various metal compounds (B) so far described may preferably be used alone or in combination, among which are more preferred magnesium carbonate, magnesium oxide, magnesium hydroxcarbonate, calcium carbonate, calcium oxide, calcium magnesium carbonate, aluminum oxide, sodium aluminate, calcium aluminate, alumina gel, titanium(II) oxide, titanium(III) oxide, titanium(IV) oxide, magnesium metatitanate, calcium metatitanate, sodium metatitanate or barium metatitanate.

The further preferred of the metal compounds (B) so far mentioned are magnesium oxide, calcium carbonate, calcium oxide, aluminum oxide, sodium aluminate, calcium aluminate, alumina gel, titanium(III) oxide, titanium(IV) oxide, magnesium metatitanate, calcium metatitanate, and mixtures thereof.

The metal compounds (B) used in this invention may be used in any form, however, it is desirable to use them in the form of granules or powder having a particle size of preferably 0.1$\mu$–3.0 mm, more preferably 1$\mu$–1.0 mm and most preferably 1μ–500μ. In a case where such granules or powder is classified into primary particles and secondary particles (these secondary particles being produced by the primary particles being bonded together), said particle sizes indicate those of the secondary particles.

The solvent (C) used in this invention is at least one member selected from (1) aliphatic or alicyclic hydrocarbons having 3–20 carbon atoms, preferably 3–8 carbon atoms, (2) saturated aliphatic or saturated alicyclic monohydric alcohols having 1–10 carbon atoms, preferably 1–5 carbon atoms, (3) liquid hydrogen sulfide and (4) liquid carbon dioxide.

The aliphatic or alicyclic hydrocarbons (C)(1) may be saturated or unsaturated hydrocarbons, and the aliphatic hydrocarbons may be a straight-chain or branched hydrocarbon. The saturated aliphatic hydrocarbons used herein include, for example, propane, n-butane, methylpropane, n-pentane, methylbutane, ethylpropane, n-hexane, n-heptane, n-octane, n-nonane, n-decane, 2,3-diethylhexane, 2,3,5-trimethylheptane, n-dodecane, 3-ethyl-5-butyloctane, n-pentadecane, 3-butyl-6-methyldecane, n-octadecane and n-nonadecane. The saturated alicyclic hydrocarbons include, for example, cyclopentane, cyclohexane, decalin, 2-methyldecalin, heptylcyclohexane, octylcyclohexane and dodecylcyclopentane. The unsaturated aliphatic hydrocarbons include, for example, 1-butene, 1-pentene, 1-hexene, 2-methyl-1-pentene, 1-heptene, 3-ethyl-1-pentene, 1-octene, 3-methyl-1-octene and 1-decene. The unsaturated alicyclic hydrocarbons include, for example, cyclopentene, cyclohexene, 2-methylcyclohexene, 2-ethylcyclopentene, 2-propylcyclopentene, 2-butylcyclopentene and octahydronaphthalene.

The solvents (C)(I) are illustrated by the aforesaid hydrocarbons and mixtures thereof, and the preferred ones are propane, n-butane, n-heptane, n-hexane, n-heptane, cyclopentane, cyclohexane, cyclopentene, cyclohexene, 2-methylcyclohexene and mixtures thereof.

The solvents (C)(I) used herein also include LPG fractions, light gasoline fractions, heavy gasoline fractions and kerosene fractions, each obtained by the distillation of crude oils at atmospheric pressure, these fractions being each a mixture of the above-mentioned various hydrocarbons.

The saturated aliphatic and alicyclic monohydric alcohols (C)(2) include, for example, methanol, ethanol, n-propanol, isopropanol, n-butanol, n-pentanol, n-hexanol, n-heptanol, n-octanol, cyclopentanol, cyclohexanol and mixtures thereof with n-propanol, isopropanol, n-butanol, n-pentanol and mixtures thereof being preferred.

The solvents (C) which are at least one member selected from the above-mentioned hydrocarbons (1) and alcohols (2) as well as liquid hydrogen sulfide (3) and liquid carbon dioxide, may be pure or may contain a small amount of impurities such as water. They may be used alone or in combination. The solvents which may preferably be used alone include propane, n-butane, n-pentane, n-hexane, n-heptane, n-propanol, isopropanol and n-butanol. The solvents which may preferably be used in combination are a mixture of a saturated aliphatic hydrocarbon selected from propane, n-butane and n-pentane with a saturated aliphatic monohydric alcohol selected from n-propanol, isopropanol and n-butanol, with a mixture of n-pentane with n-butanol being especially preferred.

The amount of the metal compound (B) added to the asphaltene-containing hydrocarbon (A) in this invention is 0.005–0.8 parts, preferably 0.01–0.5 parts and more preferably 0.01–0.3 parts by weight per 100 parts by weight of hydrocarbons (A).

It is apparent from the Examples and Comparative Examples that the use of the ingredient (B) in an amount by weight of more than 0.8% will result in exhibiting much inferior effects to the use thereof in an amount specified in this invention. It is one of the features of this invention to enable the asphaltene to be removed from the asphaltene-containing hydrocarbons efficiently in a sufficiently short time only by adding such a small amount of the metal compound to the asphaltene-containing hydrocarbons.

On the other hand, the amount of the solvent (C) added to the asphaltene-containing hydrocarbons (A) is 50–2,000, preferably 100–1,000 and more preferably 200–800 parts by weight per 100 parts by weight of the asphaltene-containing hydrocarbons (A).

According to this invention, the asphaltene-containing hydrocarbons (A) are mixed with the metal compound (B) and the solvent (C) to rapidly precipitate and remove the asphaltene from the hydrocarbons (A). It is preferable to allow the resulting mixture to stand still until it has been separated industrially and easily into the substantially asphaltene-free hydrocarbons (hereinafter referred to as "deasphalted oil") and the asphaltene precipitated and removed.

In the practice of this invention, separation systems of any conventional kind may be used without need of designing and constructing new systems for continuous solvent deasphalting. This invention may be carried out by the use of a conventionally-used extraction type, forced separation type or like type solvent deasphalting system thereby to obtain, as compared with conventional systems, remarkable effects such as the improvement of asphaltene removal efficiency and the shortening of time needed for the separation. In a case where this invention is practiced by the use of a solvent deasphalting system using countercurrent extraction tower, there are obtained effects such as the prevention of flooding which may otherwise be caused in, for example, the baffle tower, rotary disc tower in the extraction type system and the reduction of amount of a solvent used as compared with the conventional systems. Further, in a case where this invention is carried out by the use of a forced separation type solvent deasphalting system, there is effective in greatly reducing the load of the forced separator used.

As is mentioned above, this invention may be easily carried out with excellent effects being obtained even by the use of the conventional solvent deasphalting system. It is desirable, however, to use a simple system without such countercurrent extraction towers, forced separators and the like in order to make the best use of the advantages of this invention. Therefore, the most preferable system for carrying out this invention is a gravity precipitation type solvent deasphalting system in which the separation of asphaltene is continuously effected only by settlers. It will be impossible to effect precipitation separation of asphaltene by allowing asphaltene-containing hydrocarbons to stand still if the conventional systems are used; for this reason, the conventional systems need the countercurrent extraction towers, cyclones and forced separators such as centrifuges. In contrast, this invention enables such precipitation separation of asphaltene to be easily effected since the asphaltene is rapidly precipitated for its separation from asphaltene-containing hydrocarbons according to this invention. According to this invention, wholesale installations such as countercurrent extraction towers and forced separators, can be dispensed with to effect a process for the solvent deasphalting of asphaltene-containing hydrocarbons, whereby the process is greatly enhanced in economy.

In this invention, the metal compound (B) and the solvent (C) may be added to the asphaltene-containing hydrocarbons in any order and in any way. It is possible to add the metal compound (B) to the hydrocarbons and then add the solvent thereto by means of line mixing or the like, however, it is preferable from the view-point of separation efficiency to add the metal compound (B) and the solvent (C) at the same time to the hydrocarbons or to add the solvent and then the metal compound (B) to the hydrocarbons. In a case where it is attempted to add the compound (B) and the solvent (C) at the same time to the hydrocarbons, these metal compound (B) and solvent (C) may be added through their respective lines to the hydrocarbons or may be mixed together for subsequent addition of the resulting mixture to the hydrocarbons. Further, the metal compound (B) may be added in two portions, one portion being added together with the solvent and the other being added downstream of the line to promote precipitation of the asphaltene.

In a case where this invention is carried out by a gravity precipitation type solvent deasphalting process, it is preferable that either the asphaltene-containing hydrocarbons, the metal compound (B) and solvent are mixed together on a mixer to form a mixture or the metal compound (B) is mixed firstly with the solvent and secondly with the hydrocarbons to form a mixture and then the thus formed mixture is introduced into settlers where it is allowed to stand still for precipitation and separation of the asphaltene from the mixture. It is also preferable that the asphaltene-containing hydrocarbons and the solvent are mixed together by a mixer, line mixing or the like, the resulting mixture is charged into a settler and the metal compound (B) is then added to the mixture in the settler.

In a case where this invention is effected by a solvent deasphalting system using countercurrent extraction tower, it is preferable that a line for feeding the metal compound (B) is connected to a line for feeding the solvent thereby to form a mixture of the solvent and metal compound (B), and the resulting mixture is then introduced into the extraction tower at the bottom since this procedure can dispense with reconstruction of the existing installations for effecting the solvent deasphalting. Further, in a case where this invention is carried out by a forced separation type solvent deasphalting process, it is preferable that either a line for feeding the compound (B) is connected to a line for feeding the solvent thereby to form a solvent-metal compound (B) mixture which is then mixed with the hydrocarbons to form a three-component mixture, or the hydrocarbons, the metal compound (B) and solvent are mixed together on a mixer to form a three-component mixture, and the three-component mixture is then introduced into a forced separator for separation.

In one embodiment of this invention, the asphaltene-containing hydrocarbons are subjected to primary asphaltene separation by the use of a conventional solvent deasphalting process using a countercurrent extraction tower or forced separator, a deasphalted oil-solvent mixture from the tower or separator is incorporated with the metal compound (B) to separate the asphaltene still remaining in said mixture and the metal compound (B)-incorporated mixture is then introduced into settlers for effecting secondary separation of asphaltene. It is also possible to further add the metal compound (B) at the time of primary separation in accordance with this invention.

The temperature used in the process of this invention varies depending on the kind of the solvent (C) used. The use of too low a temperature will result in deteriorating the fluidity of asphaltene-containing hydrocarbons to be treated and rendering it difficult to handle the asphaltene separated, the use of too high a temperature will result in not only requiring a high pressure to prevent evaporation of the solvent but also tending to cause condensation reactions and polymerization reactions; this is undesirable for the process of this invention. Thus, in general, the temperature used in the present process for a time from the addition of the metal compound (B) and solvent (C) to the separation of the asphaltene is in the range of preferably 0°–250° C., more preferably 20°–200° C. and most preferably 40°–150° C. It is also possible in this invention to promote precipitation of the asphaltene by adding the metal compound (B) and solvent to the asphaltene-containing hydrocarbons and then heating the resulting mixture to within said temperature range. In addition, the lower limit of the pressure used in this invention should be such that the solvent is not evaporated; however, it is generally in the range of preferably 0.5–150 $Kg/cm^2$, more preferably atmospheric pressure up to 80 $Kg/cm^2$ and most preferably atmospheric pressure up to 50 $Kg/cm^2$.

The oil-solvent mixture from which the asphaltene has been removed in the countercurrent extraction tower, forced separator or the like, is passed to a solvent recovery unit if necessary. This oil-solvent mixture may be treated in any way to recover the solvent therefrom and conventional solvent recovery units may be used for this recovery purpose. Deasphalted oils obtained by removing the solvent from the oil-solvent mixture may usually be used as a starting oil to be treated in the subsequent step of petroleum refining such as fluidized catalytic cracking, hydrogenolysis, hydrodesulfurization or the like.

On the other hand, it is also possible to recover the solvent which is contained in the asphaltene separated in the countercurrent extraction tower, forced separator or the like, by any optional solvent recovery unit if necessary. The asphaltene so obtained may be mixed with, for example, a heavy oil for use as fuel and may also be used as a blending material for asphalt or as a material for activated carbon and the like.

This invention will be better understood by reference to the accompanying drawings in which:

BRIEF DESCRIPTION OF THE FIGURE

Referring now to FIG. 1, asphaltene-containing hydrocarbons to be treated is charged through a line 1 to a mixer A where they are mixed with a metal compound (compound (B)) and a solvent supplied to the mixer A respectively through lines 2 and 3 thereby to form a mixture. To promote precipitation of the asphaltene, the thus formed mixture is passed through a line 4 to a heater B by which the mixture is heated to a predetermined temperature selected depending on the kind of the solvent used and under such a pressure that the solvent does not boil at the predetermined temperature, after which the mixture so heated is charged into a settler C. The mixture is allowed to stand still in the settler for a fixed time, preferably for 10 minutes to one hour whereby the asphaltene is precipitated and removed. It is possible at this time to further supply the metal compound through a line 5 in order to accelerate precipitation of the asphaltene. Not only a single settler but also a series of settlers may be used as required. After the asphaltene is removed by precipitation in this manner, the resulting deasphalted oil-solvent mixture present in the upper portion of the settler is passed through a line 6 to a solvent recovery unit D for removing the solvent from the mixture and the deasphalted oil obtained is then recovered through a line 7. On the other hand, the asphaltene precipitated in the lower portion of the settler is recovered through a line 9. In a case where the asphaltene contains a large amount of the solvent, it is passed through a line 10 to a solvent recovery unit E for removing the solvent therefrom and then recovered through a line 11. The solvent recovered at the solvent recovery units D and E is recycled to the mixer A respectively through the line 8 and a line 12 and further through a line 3. At this time a fresh solvent may be supplied through a line 13 as required.

Figure 1:
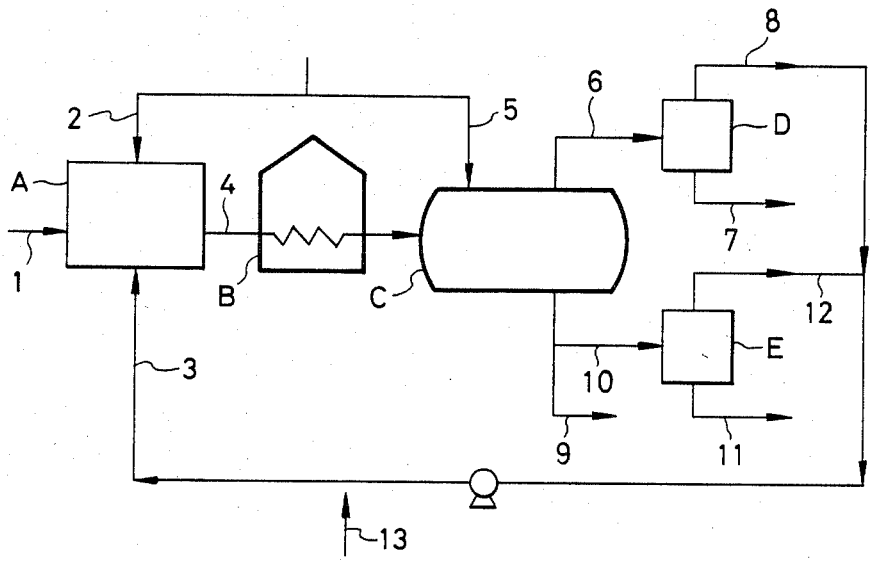
FIG. 1 is a flow sheet of a preferable process for solvent deasphalting asphaltene-containing hydrocarbons in accordance with this invention.

The operational conditions of the process as illustrated in FIG. 1 will depend greatly on the kind of a solvent used. For example, in a case where n-heptane is used as the solvent, the process may be effected at atmospheric pressure and preferably 60°-98° C. by the use of the heater.

This invention will be further better understood by reference to FIG. 1 and the following non-limitative Examples in comparison with Comparative Examples.

EXAMPLES 1-19 AND COMPARATIVE EXAMPLES 1-3

In Examples 1-16, using the process as shown in FIG. 1, the following experiments were made to produce deasphalted oils from an asphaltene-containing residual oil obtained by the distillation of Arabian light crude oil at a reduced pressure, the properties of the residual oil being as shown in Table 1.

A starting oil which was the residual oil, and n-heptane as a solvent, were charged at 1.0 Kg/hr and 4.0 Kg/hr through lines 1 and 3 into a mixer A, respectively. The materials so charged in the mixer were thoroughly mixed together at room temperature (25° C.) and atmospheric pressure and then incorporated through a line 2 with metal compound in each of such amounts as indicated in Table 3 to obtain a liquid mixture. The thus obtained liquid mixtures were each heated to 90° C. with steam in a heater B and then introduced into a settler C where the asphaltene was precipitated and separated. Then, the deasphalted oil-solvent mixture was passed through a line 6 to a solvent recovery unit D to separate the solvent from the mixture thereby obtaining through a line 7 a deasphalted oil the yields and properties of which are as indicated in Table 2. The overall treating time was about 30 minutes and the residence time of the liquid mixture in the settler was about 20 minutes.

In Example 17, the procedure of Examples 1-16 was followed except that an asphaltene-containing residual oil (the properties of which are as shown in Table 3) obtained by the distillation of Kafji crude oil at atmospheric pressure was substituted for the aforesaid residual oil obtained from Arabian light crude oil. In Example 18, the procedure of Examples 1-16 was followed except that n-pentane was substituted for n-heptane as the solvent and the process conditions were 150° C. and 20 Kg/cm$^2$. In Example 19, the procedure of Examples 1-16 was followed except that n-pentane was substituted for n-butanol as the solvent and the process conditions were 110° C.

For comparison, in Comparative Example 1 the procedure of Examples 1-16 was followed except that metal compound was not used, and in each of Comparative Examples 2 and 3 the same procedure was followed except that metal compound was used in a larger amount than specified in the present invention.

The results are as indicated in Table 2.

TABLE 1

| | | |
|---|---|---|
| Yield of residual oil, based on crude oil (wt. %) | | 25.8 |
| Specific gravity (15/4° C.) | | 1.003 |
| Residual carbon (wt. %) | | 18.16 |
| Ash (wt. %) | | 0.015 |
| Metal content (ppm) | V | 98.2 |
| | Ni | 30.1 |
| H/C ratio (mol) | | 1.40 |
| Analysis of composition (wt. %) | Saturated ingredients | 18.2 |
| | Aromatic ingredients | 52.5 |
| | Resinous ingredients | 23.3 |
| | Asphaltene | 6.0 |

TABLE 2

| | Materials | | | Conditions | | Yield and Properties | | | |
|---|---|---|---|---|---|---|---|---|---|
| | | | | | | | Metal (ppm) | | |
| | Type | Amount (wt. %) | Solvent | Temp. (°C.) | Pressure | Yield (wt. %) | V | Ni | Asphaltene (wt. %) |
| Exp. 1 | magnesium carbonate | 0.3 | n-heptane | 90 | Atmospheric | 82 | 19 | 6 | <0.01 |
| Exp. 2 | magnesium oxide | 0.8 | " | 90 | Atmospheric | 80 | 18 | 5 | <0.01 |
| Exp. 3 | calcium carbonate | 0.4 | " | 90 | Atmospheric | 81 | 17 | 5 | <0.01 |
| Exp. 4 | calcium oxide | 0.5 | " | 90 | Atmospheric | 83 | 19 | 7 | <0.01 |
| Exp. 5 | calcium magnesium carbonate | 0.08 | " | " | Atmospheric | 84 | 20 | 7 | <0.01 |
| Exp. 6 | aluminum oxide | 0.1 | " | " | Atmospheric | 82 | 18 | 6 | <0.01 |
| Exp. 7 | sodium aluminate | 0.04 | " | " | Atmospheric | 83 | 19 | 7 | <0.01 |
| Exp. 8 | calcium aluminate | 0.06 | " | " | Atmospheric | 84 | 20 | 6 | <0.01 |
| Exp. 9 | alumina gel | 0.2 | " | " | Atmos- | 80 | 16 | 4 | <0.01 |

TABLE 2-continued

| | Materials | | | Conditions | | Yield and Properties | | | |
|---|---|---|---|---|---|---|---|---|---|
| | Type | Amount (wt. %) | Solvent | Temp. (°C.) | Pressure | Yield (wt. %) | Metal (ppm) V | Metal (ppm) Ni | Asphaltene (wt. %) |
| Exp. 10 | titanium(II) oxide | 0.1 | " | " | pheric Atmos-pheric | 82 | 18 | 5 | <0.01 |
| Exp. 11 | titanium(III) oxide | 0.05 | " | " | Atmos-pheric | 83 | 19 | 6 | <0.01 |
| Exp. 12 | titanium(IV) oxide | 0.6 | " | 90 | Atmos-pheric | 82 | 15 | 3 | <0.01 |
| Exp. 13 | magnesium metatitanate | 0.2 | " | " | Atmos-pheric | 81 | 17 | 6 | <0.01 |
| Exp. 14 | calcium metatitanate | 0.02 | " | " | Atmos-pheric | 84 | 19 | 7 | <0.01 |
| Exp. 15 | sodium metatitanate | 0.15 | " | " | Atmos-pheric | 82 | 18 | 6 | <0.01 |
| Exp. 16 | barium metatitanate | 0.3 | " | " | Atmos-pheric | 80 | 17 | 5 | <0.01 |
| Comp. Exp. 1 | nothing | — | " | " | Atmos-pheric | 90 | 47 | 12 | 2.5 |
| Comp. Exp. 2 | calcium metatitanate | 3.5 | " | " | Atmos-pheric | 68 | 20 | 7 | <0.05 |
| Comp. Exp. 3 | magnesium carbonate | 2.3 | " | " | Atmos-pheric | 71 | 23 | 8 | <0.05 |
| Exp. 17(1) | sodium aluminate | 0.13 | " | " | Atmos-pheric | 86 | 18 | 6 | <0.05 |
| Exp. 18 | titanium(IV) oxide | 0.006 | n-pentane | 150 | 20 Kg/cm$^2$ | 83 | 11 | 3 | 0 |
| Exp. 19 | calcium carbonate | 0.01 | n-butanol | 110 | Atmos-pheric | 78 | 10 | 3 | 0 |

Note
(1)A residual oil (the properties thereof being as shown in Table 4) obtained by distillation of Kafji crude oil at atmospheric pressure was used.

TABLE 3

| | | |
|---|---|---|
| Yield of residual oil (wt. %, based on crude oil) | | 55.2 |
| Specific gravity (15/4° C.) | | 0.9821 |
| Residual carbon (wt. %) | | 13.73 |
| Ash (wt. %) | | 0.027 |
| Metal ingredient | V | 97.3 |
| | Ni | 31.3 |
| H/C ratio (mol) | | 1.50 |
| Analysis of composition (wt. %) | Saturated ingredients | 26.8 |
| | Aromatic ingredients | 48.4 |
| | Resinous ingredients | 11.3 |
| | Asphaltene | 13.5 |

As is apparent from the foregoing Examples and Comparative Examples, in a case where asphaltene-containing hydrocarbons are incorporated only with a solvent (Comparative Example 1), it is substantially impossible to separate the asphaltene from the hydrocarbons only by specific gravity precipitation, and the resulting deasphalted hydrocarbons if any in Comparative Example 1 would contain a large amount of metal ingredients as compared with those obtained according to the present invention. Accordingly, it is essential for an existing separation installation to include therein special units such as a countercurrent extraction tower and a forced separator in order to effect satisfactory separation of asphaltene.

In contrast, the addition of both at least one of the specific solvents and a very small amount of at least one of the specific metal compound in accordance with this invention, will result in rapid precipitation of asphaltene from an asphaltene-containing oil. It will therefore be possible to separate asphaltene continuously with satisfactory selectivity by the use of a simplified separation installation without such special units.

On the other hand, it is also apparent from the foregoing that there were exhibited somewhat good results in comparative cases wherein a metal compound used in a larger amount (Comparative Examples 2 and 3) than specified in the present invention, as compared with cases wherein such a metal compound was not used, and that very excellent results were exhibited in the present cases (Examples 1–19) as compared with said comparative cases.

As is apparent from the above, the oil containing metals and asphaltene each in a small amount is obtained in a better yield in Examples 1–19 than in Comparative Examples 2 and 3.

What is claimed is:

1. A continuous process for solvent deasphalting asphaltene-containing hydrocarbons which consists of (I) mixing (A) 100 parts by weight of asphaltene-containing hydrocarbons with (B) 0.005–0.8 parts by weight per 100 parts by weight of said asphaltene-containing hydrocarbons of at least one metal compound selected from the group consisting of carbonates and oxides of magnesium, calcium, aluminum and titanium and (C) 50–2,000 parts by weight per 100 parts by weight of said asphaltene-containing hydrocarbons of at least one member selected from the group consisting of the following solvents (1)–(4):

(1) aliphatic and alicyclic hydrocarbons having 3–20 carbon atoms, (2) saturated aliphatic and saturated alicyclic monohydric alcohols having 1–10 carbon atoms, (3) liquid hydrogen sulfide and (4) liquid carbon dioxide to form a mixture of the materials (A), (B) and (C) and then (II) making the thus formed mixture stand still to precipitate and separate the asphaltene therefrom thereby obtaining a deasphalted oil.

2. A continuous process according to claim 1, wherein the mixing, precipitation and separation are carried out at a temperature of 0°–250° C. under a pressure of 0.5–150 Kg/cm$^2$ with the proviso that the pressure is so high as to prevent evaporation of the solvent used.

3. A continuous process according to claim 1, wherein the metal compound is magnesium carbonate, magnesium oxide, magnesium hydroxycarbonate, calcium carbonate, calcium oxide, calcium magnesium carbonate, aluminum oxide, sodium aluminate, calcium aluminate, alumina gel, titanium(II) oxide, titanium(III) oxide, titanium(IV) oxide, magnesium metatitanate, calcium metatitanate, sodium metatitanate or barium metatitanate.

4. A continuous process according to claim 1, wherein the metal compound is of average particle size 0.1μ–3.0 mm.

5. A continuous process according to claim 3, wherein the metal compound has the average particle size of 0.1μ–3.0 mm.

6. A continuous process according to claim 1, wherein the solvent is propane, n-butane, n-pentane, n-hexane, n-heptane, n-propanol, isopropanol, n-butanol or a mixed solvent containing (1) a hydrocarbon selected from the group consisting of propane, n-butane and n-pentane and (2) an alcohol selected from the group consisting of n-propanol, isopropanol and n-butanol.

7. A continuous process according to claim 1, wherein the asphaltene-containing hydrocarbons are a residual oil obtained by atmospheric pressure distillation of a crude oil, a residual oil obtained by reduced pressure distillation and a residual oil obtained by cracking of petroleum.

8. The process according to claim 1 wherein said metal compound is used together with a double salt which is a member selected from the group consisting of magnesium hydroxycarbonate; calcium magnesium carbonate; magnesium aluminum oxide; calcium aluminate; magnesium metatitanate; and calcium metatitanate.

* * * * *